US006061041A

United States Patent [19]

Yoshida

[11] Patent Number: 6,061,041

[45] Date of Patent: May 9, 2000

[54] APPARATUS FOR DRIVING ELECTROLUMINESCENCE DEVICE AND METHOD OF DRIVING ELECTROLUMINESCENCE DEVICE

[75] Inventor: Takayoshi Yoshida, Yonezawa, Japan

[73] Assignees: Pioneer Electronic Corporation, Tokyo-to; Tohoku Pioneer Electronic Corporation, Yamagata, both of Japan

[21] Appl. No.: 09/042,953

[22] Filed: Mar. 17, 1998

[30] Foreign Application Priority Data

Mar. 18, 1997 [JP] Japan ..... P09-064951

[51] Int. Cl.[7] ..... G09G 3/30

[52] U.S. Cl. ..... 345/76; 345/77

[58] Field of Search ..... 345/76, 77, 78, 345/79, 80, 74, 75, 147, 204, 211, 212, 213; 315/169.1, 169.3, 169.2

[56] References Cited

U.S. PATENT DOCUMENTS 4,443,741 4/1984 Tanaka et al. ..... 345/78
5,519,288 5/1996 Tatsumi et al. ..... 345/76
5,550,557 8/1996 Kapoor et al. ..... 345/76
5,559,402 9/1996 Corrigan, III ..... 345/76

*Primary Examiner*—Xiao Wu
*Attorney, Agent, or Firm*—Ladas & Parry

[57] ABSTRACT

An apparatus for driving an electroluminescence device by supplying an alternating current to the electroluminescence device, the apparatus having: a direct voltage source; a constant voltage control device for generating a direct current having a constant voltage on the basis of an output of the direct voltage source; a constant current control device for generating a direct current having a constant current on the basis of the output of the direct voltage source; a selecting device for selecting either one of the direct current having the constant voltage and the direct current having the constant current; and a converting device for converting the selected direct current to the alternating current to be supplied to the electroluminescence device.

24 Claims, 7 Drawing Sheets

APPARATUS FOR DRIVING ELECTROLUMINESCENCE DEVICE AND METHOD OF DRIVING ELECTROLUMINESCENCE DEVICE

BACKGROUND OF THE INVENTION

1. Field of the Invention

The present invention relates to an apparatus for and a method of driving an electroluminescence device by applying an alternating voltage to it.

2. Description of the Related Art

An electroluminescence device (Hereinafter, it is referred to as an "EL device".) is a type of emission device used for a back light of a liquid crystal panel.

The EL device has an emission layer and two electrodes, and the emission layer is sandwiched between the electrodes. The emission layer includes a dielectric substance, in which a fluorescence substance is uniformly dispersed. If an alternating voltage is applied to the EL device, the alternating voltage is applied to the fluorescence substance in the emission layer, and the EL device emits light.

Further, the EL device has a characteristic that brightness increases in proportion to an amplitude and a frequency of the applied alternating voltage. For this reason, it is more suitable for driving the EL device to use an alternating current generated by converting a direct current, as compared with an use of an commercial alternating current.

In order to generate the alternating current by converting the direct current, an inverter and a direct voltage source are needed. Further, either a constant-current supply system or a constant-voltage supply system is generally used for controlling the direct current to be supplied to the inverter from the direct voltage source. The constant-current supply system is a system in which a direct current having a constant current is always supplied to the inverter. On the other hand, the constant voltage supply system is a system in which a direct current having a constant voltage is always supplied to the inverter.

As shown in FIGS. 6A and 6B, a characteristic of the brightness of the EL device varies depending on whether either the constant-current supply system or the constant-voltage supply system is used for controlling the direct current to be supplied to the inverter.

As shown in FIG. 6A, in the case that the constant-voltage supply system is used, there is an advantage that the brightness is stable at the beginning of driving the EL device. However, there is a disadvantage that the brightness decreases with a driving time of the EL device, with the result that the lifetime of the EL device (i.e. the period of time in which the EL device keeps the effective brightness) is short. This is because the EL device has a characteristic that the impedance thereof increases with the driving time. When the impedance of the EL device increases, a driving current to be used for driving the EL device decreases in the case of the constant-voltage supply system. Therefore, the brightness of the EL device decreases, and the effective brightness cannot be kept for a long time.

On the other hand, as shown in FIG. 6B, in the case that the constant-current supply system is used, there is an advantage that the effective brightness can be kept for a long time. Namely, when the impedance of the EL device increases with the driving time of the EL device, a driving voltage to be used for driving the EL device increases in accordance with the increase in the impedance of the EL device. Therefore, the brightness of the EL device is compensated by the increase in the driving voltage. This is because the current supplied to the inverter is always constant in the case of the constant-current supply system.

However, as shown in FIG. 6B, in case that the constant-current supply system is used, there is a disadvantage that the brightness of the EL device sharply increase to a high brightness exceeding the normal brightness at the beginning of driving the EL device. Namely, the EL device has a characteristic that the impedance thereof sharply increases at the beginning of driving. Therefore, the driving voltage sharply increases with the increase in the impedance of the EL device at the beginning of driving. As a result, the brightness of the EL device sharply increases at the beginning of driving. Thereafter, the brightness slowly decreases to the normal brightness with the decrease in the impedance of the EL device.

Further, if the brightness of the EL device becomes high, a deterioration of the EL device relatively becomes fast. Accordingly, the sharp increase in the brightness of the EL device at the beginning of driving makes the deterioration of the EL device fast.

SUMMARY OF THE INVENTION

It is therefore an object of the present invention to provide an apparatus for and a method of driving an EL device which can reduce a deterioration of the EL device and extend a lifetime of the EL device.

The above mentioned object can be achieved by an apparatus for driving an EL device by supplying an alternating current to the EL device, the apparatus having: a direct voltage source; a constant voltage control device for generating a direct current having a constant voltage on the basis of an output of the direct voltage source; a constant current control device for generating a direct current having a constant current on the basis of the output of the direct voltage source; a selecting device for selecting either one of the direct current having the constant voltage and the direct current having the constant current; and a converting device for converting the selected direct current to the alternating current to be supplied to the EL device.

Namely, in a case that the direct current having the constant voltage is converted to the alternating current and the EL device is driven by using the alternating current, the brightness of the EL device is stable at the beginning of driving. Therefore, it is possible to prevent the sharp increase at the beginning of the driving time. Accordingly, it is possible to reduce a deterioration of the EL device.

On the other hand, in a case that the direct current having the constant current is converted to the alternating current and the EL device is driven by using the alternating current, the voltage applied to the EL device through the converting device can be increased in accordance with the increase of the impedance of the EL device. Therefore, the decrease of the-brightness of the EL device can be compensated, with the result that the effective brightness of EL device can be maintained for a long time. Accordingly, it is possible to extend a lifetime of the EL device.

Thus, if either one of the direct current having the constant voltage and the direct current having the constant current is selected on the basis of a condition of brightness of the EL device and the selected direct current is converted to the alternating current to be supplied to the EL device, it is possible to reduce a deterioration of the EL device and to extend a lifetime of the EL device.

More specifically, the selecting device may select the direct current having the constant voltage between a beginning of driving the EL device and a predetermined time and selects the direct current having the constant current after the predetermined time, and the predetermined time is predetermined on the basis of a change of brightness of the EL device.

Further, the predetermined time may be a time when brightness of the EL device returns to an initial brightness after brightness of the EL device temporarily increases above the initial brightness at the beginning of driving the EL device.

Furthermore, the predetermined time may be a time immediately before brightness of the EL device decrease to a predetermined brightness, and the predetermined brightness corresponds to a lower limit of a brightness range that an effective brightness of the EL device is maintained.

More specifically, the selecting device may have: a current detecting device for detecting a current value of a direct current flowing into the converting device; a determining device for determining whether or not the detected current value is less than a predetermined current value; a switching device for switching from the direct current having the constant voltage to the direct current having the constant current when the determining device determines that the detected current value is less than the predetermined current value.

In this case, the predetermined current value may be a current value of a direct current flowing into the converting device when brightness of the EL device returns to an initial brightness after brightness of the EL device temporarily increases at the beginning of driving the EL device.

On the other hand, the selecting device may have: a brightness detecting device for detecting a brightness of the EL device; a determining device for determining whether or not the detected brightness is less than a predetermined brightness; a switching device for switching from the direct current having the constant voltage to the direct current having the constant current when the determining device determines that the detected brightness is less than the predetermined brightness.

The above mentioned object can be also achieved by an apparatus for driving an EL device by supplying an alternating current to the EL device, the apparatus having: a direct voltage source; a constant voltage control device for generating a direct current having a constant voltage on the basis of an output of the direct voltage source; a constant brightness control device for generating a direct current having a voltage which changes with a brightness of the EL device, on the basis of an output of said direct voltage source; a selecting device for selecting either one of the direct current having the constant voltage and the direct current having the changing voltage; and a converting device for converting the selected direct current to the alternating current to be supplied to the EL device.

Namely, in a case that the direct current having the constant voltage is converted to the alternating current and the EL device is driven by using the alternating current, the brightness of the EL device is stable at the beginning of driving. Therefore, it is possible to prevent the sharp increase at the beginning of the driving time. Accordingly, it is possible to reduce a deterioration of the EL device.

On the other hand, in a case that the direct current having the voltage which changes with the brightness of the EL device is converted to the alternating current and the EL device is driven by using the alternating current, the voltage applied to the EL device through the converting device can be increased in accordance with the increase of the impedance of the EL device. Therefore, the decrease of the brightness of the EL device can be compensated, with the result that the effective brightness can be maintained for a long time. Accordingly, it is possible to extend a lifetime of the EL device.

Thus, if either one of the direct current having the constant voltage and the direct current having the voltage which change with the brightness of the EL device is selected on the basis of a condition of brightness of the EL device and the selected direct current is converted to the alternating current to be supplied to the EL device, it is possible to reduce a deterioration of the EL device and to extend a lifetime of the EL device.

The above mentioned object can be achieved by a method of driving an EL device by supplying an alternating current to the EL device, the method having the processes of: generating a direct current having a constant voltage; generating a direct current having a constant current; selecting either one of the direct current having the constant voltage and the direct current having the constant current; and converting the selected direct current to the alternating current to be supplied to the EL device.

Thus, it is possible to reduce a deterioration of the EL device and to extend a lifetime of the EL device.

The above mentioned object can be also achieved by a method of driving an EL device by supplying an alternating current to the EL device, the method having the processes of: generating a direct current having a constant voltage; generating a direct current having a constant current and having a voltage which changes with a brightness of the EL device; selecting either one of the direct current having the constant voltage and the direct current having the constant current; and converting the selected direct current to the alternating current to be supplied to the EL device.

Thus, it is possible to reduce a deterioration of the EL device and to extend a lifetime of the EL device.

The nature, utility, and further feature of this invention will be more clearly apparent from the following detailed description with respect to preferred embodiments of the invention when read in conjunction with the accompanying drawings briefly described below.

DETAILED DESCRIPTION OF THE PREFERRED EMBODIMENTS

Referring to the accompanying drawings, preferred embodiments of the present invention will be now explained.

I. First Embodiment

Figure 1A:
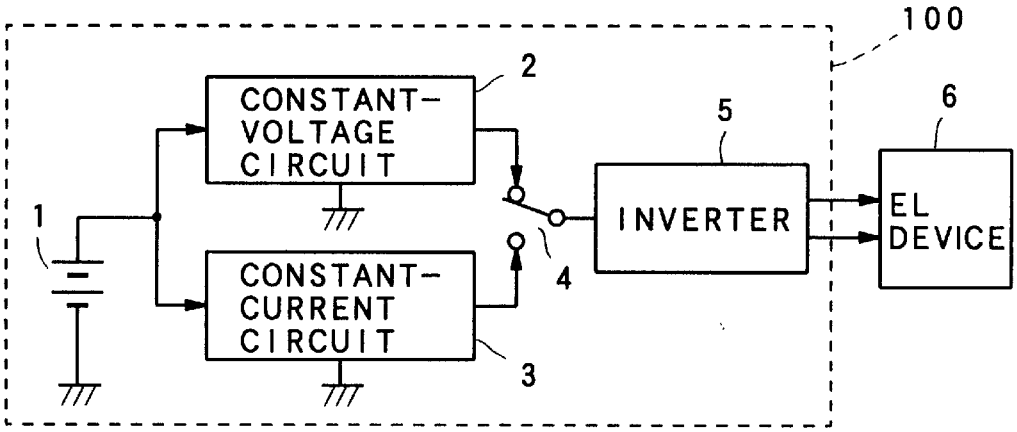
FIG. 1A is a block diagram showing an electroluminescence device driving apparatus of a first embodiment of the present invention.

FIG. 1A shows an electroluminescence device driving apparatus (Hereinafter, it is referred to as an "EL device driving apparatus".) 100 of a first embodiment of the present invention. As shown in FIG. 1A, the EL driving apparatus 100 has a direct voltage source 1, a constant-voltage circuit 2, a constant-current circuit 3, a switch 4, and an inverter 5. Further, the inverter 5 is connected to an electroluminescence device (Hereinafter, it is referred to as an "EL device".) 6.

A direct current outputted from the direct voltage source 1 is controlled by the constant-voltage circuit 2. Accordingly, a direct current having a constant voltage is always outputted from the constant-voltage circuit 2 to the switch 4.

On the other hand, the direct current outputted from the direct voltage source 1 is also controlled by the constant-current circuit 3. Accordingly, a direct current having a constant current is always outputted from the constant-current circuit 3 to the switch 4.

The switch 4 is connected to the constant-voltage circuit 2 at the beginning of driving the EL device 6, and the direct current having the constant voltage is supplied to the inverter 5. Further, the inverter 5 converts the direct current to an alternating current, and supplies the alternating current to the EL device 6 in order to drive the EL device 6.

Figure 2:
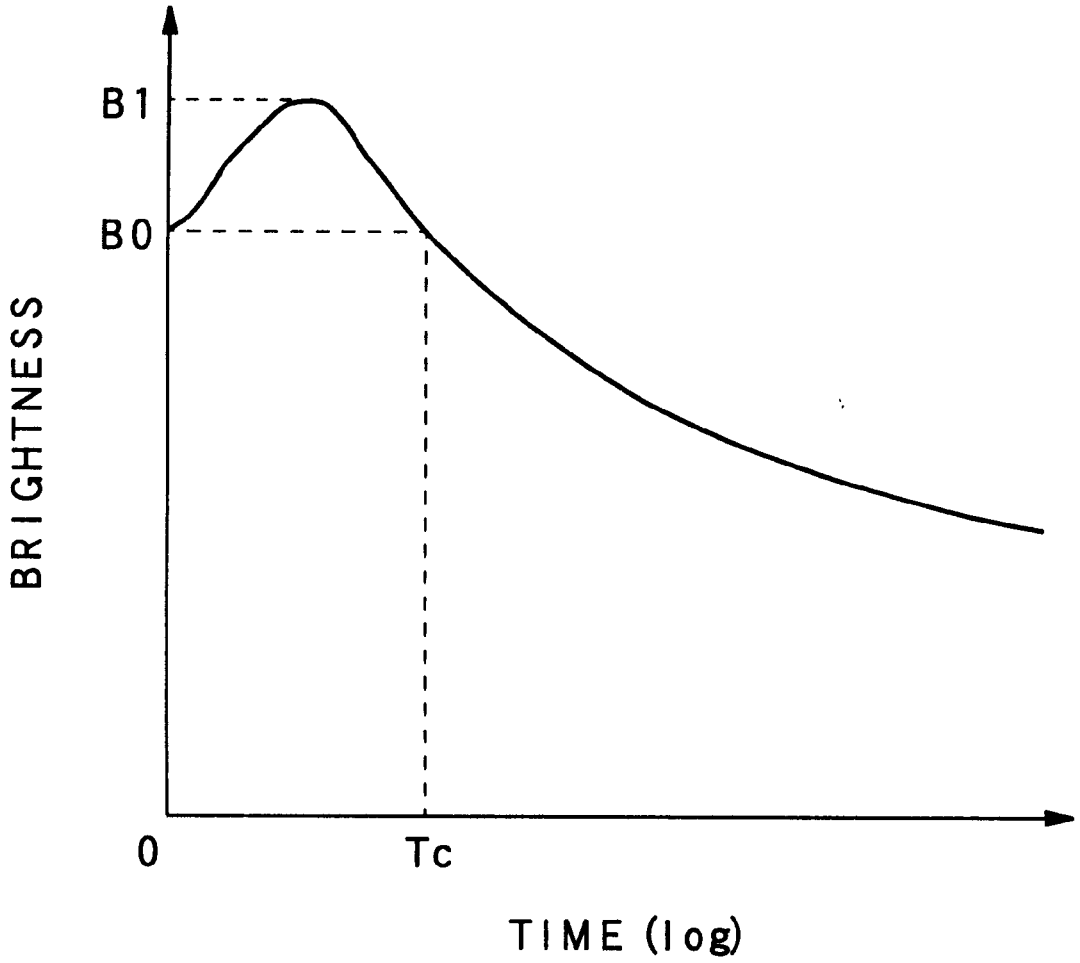
FIG. 2 is a graph showing a relation between time and brightness of the electroluminescence device in each of the first to the third embodiments of the present invention.

Next, the connection of the switch 4 is switched at the time of a Tc shown in FIG. 2 in a manual operation by the user, with the result that the switch 4 is connected to the constant-current circuit 3. Therefore, the direct current having the constant current is supplied to the inverter 5 after the time Tc. Further, the inverter 5 converts the direct current to an alternating current, and supplies the alternating current to the EL device 6 in order to drive the EL device 6.

FIG. 2 shows a relation between time and brightness of the EL device 6 when the EL device 6 is driven by using the constant-current supply system. Namely, FIG. 2 shows a change of the brightness of the EL device 6 when the EL device 6 is driven by applying the direct current having the constant current to the inverter 5. The relation is obtained by an experiment.

As shown in FIG. 2, the brightness of the EL device 6 temporarily increases to a brightness B1 from an initial brightness B0 at the beginning of driving the EL device 6 by using the constant-current supply system. Thereafter, the brightness of the EL device 6 returns to the initial brightness B0 from the brightness B1. The time Tc is a time when the brightness of the EL device 6 returns to the initial brightness B0 after the brightness temporarily increases to the brightness B1 at the beginning of driving the EL device 6 by using the constant-current supply system.

As explained above, according to the EL device driving apparatus 100 of the first embodiment, the direct current to be supplied to the inverter 5 is alternatively selected from among the direct current having the constant voltage outputted from the constant-voltage circuit 2 and the direct current having the constant current outputted from the constant-current circuit 3. At the beginning of driving the EL device 6, the direct current having the constant voltage outputted from the constant-voltage circuit 2 is selected. Therefore, it is possible to prevent the brightness of the EL device 6 from increasing to a high brightness exceeding the initial brightness. Accordingly, it is possible to reduce the deterioration of the EL device 6. After the beginning of driving the EL device 6, the direct current having the constant current outputted from the constant-current circuit 3 is selected. Therefore, it is possible to extend the lifetime of the EL device 6 (i.e. to extend the period of time in which the EL device 6 keeps the effective brightness).

Further, according to the EL device driving apparatus 100 of the first embodiment, the time Tc when the brightness of the EL device 6 returns to the initial brightness B0 after the brightness temporarily increases to the brightness B1 at the beginning of driving the EL device 6 by using the constant-current supply system is used as the time of switching the switch 4. Therefore, it is possible to change the circuits to connect with the inverter 5 from the constant-voltage circuit 2 to the constant-current circuit 3 at the best suited timing.

Next, the construction of the inverter 5 will be explained with reference to FIG. 5.

Figure 5:
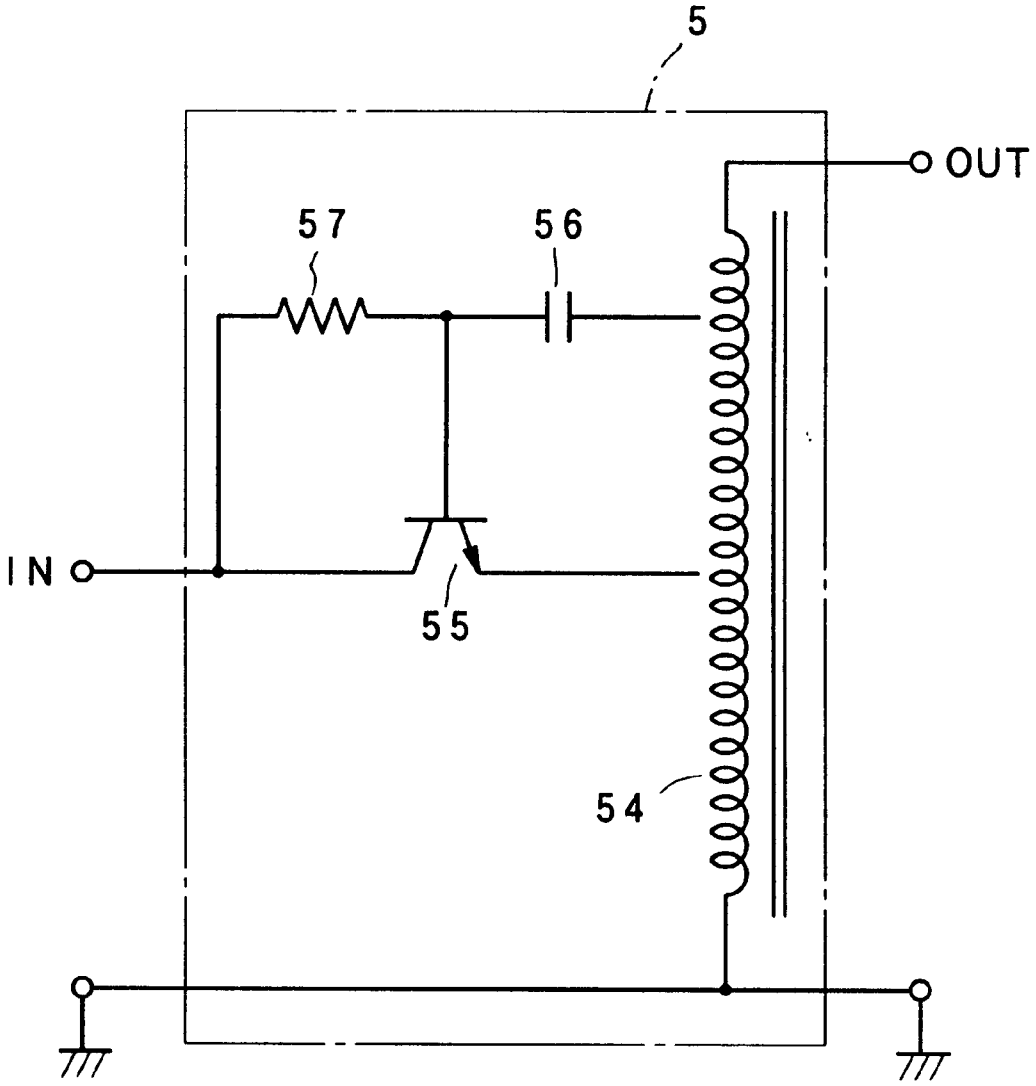
FIG. 5 is a diagram showing a configuration of an inverter.
Figure 6A:
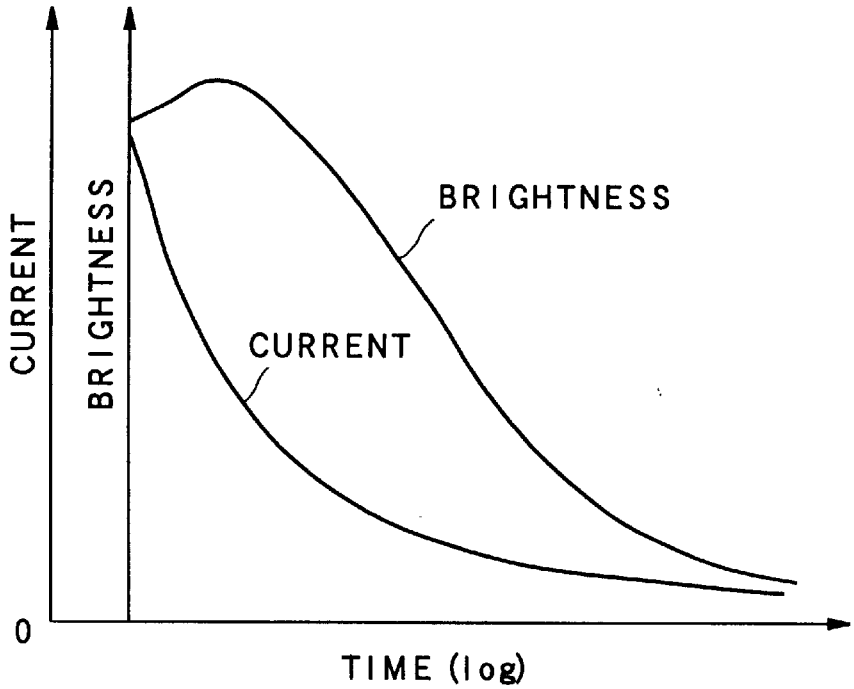
FIG. 6A is a graph showing relations between time and current and between time and brightness in the constant-voltage supply system.
Figure 6B:
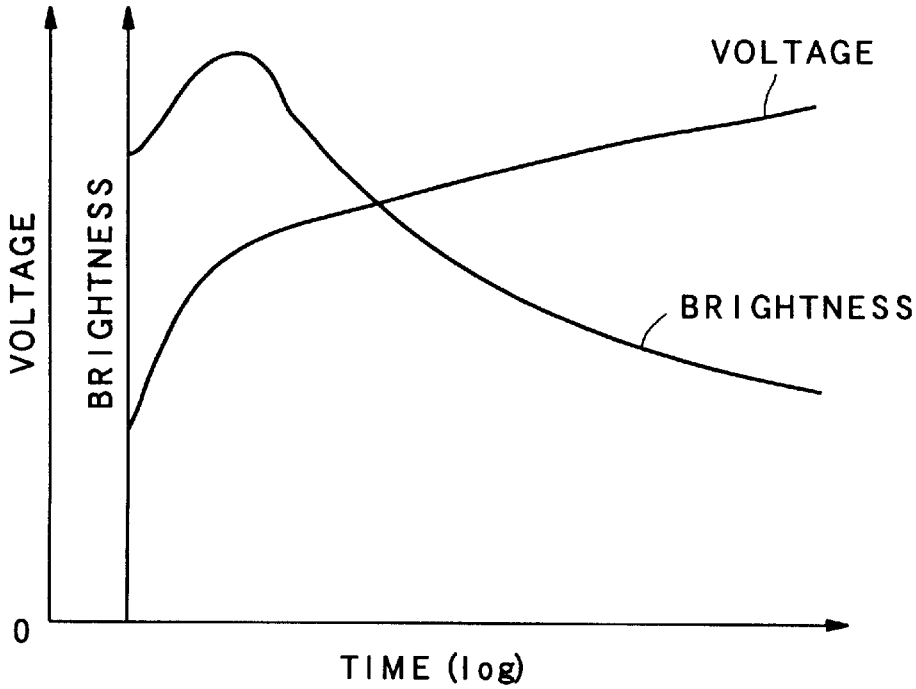
FIG. 6B is a graph showing relations between time and voltage and between time and brightness in the constant-current supply system.

As shown in FIG. 5, the inverter 5 has a transformer 54 connected to the EL device 6, a transistor 55 whose emitter terminal is connected to the transformer 54 and whose collector terminal is connected to the switch 4, a capacitor 56 connected between a base terminal of the transistor 55 and the transformer 54, and a fixed resistance 57 connected between the base terminal and the collector terminal of the transistor 55.

In the operation, when the direct current is supplied to the inverter 5, the capacitor 56 is charged. Then, when the capacitor is charged to a predetermined voltage, a bias voltage of a forward direction is applied to the base terminal of the transistor 55. Therefore, the transistor 55 becomes an on condition, and conducts the current from the collector terminal to the emitter terminal. Accordingly, the current is supplied to the transformer 54. Further, when the transformer 54 is saturated, the transistor 55 becomes an off condition. Accordingly, supplying the current to the transformer 54 is stopped. Thus, the alternating current is supplied to the transformer 54 by a repetition of the on and off conditions of the transistor 55.

II. Second Embodiment

Figure 1B:
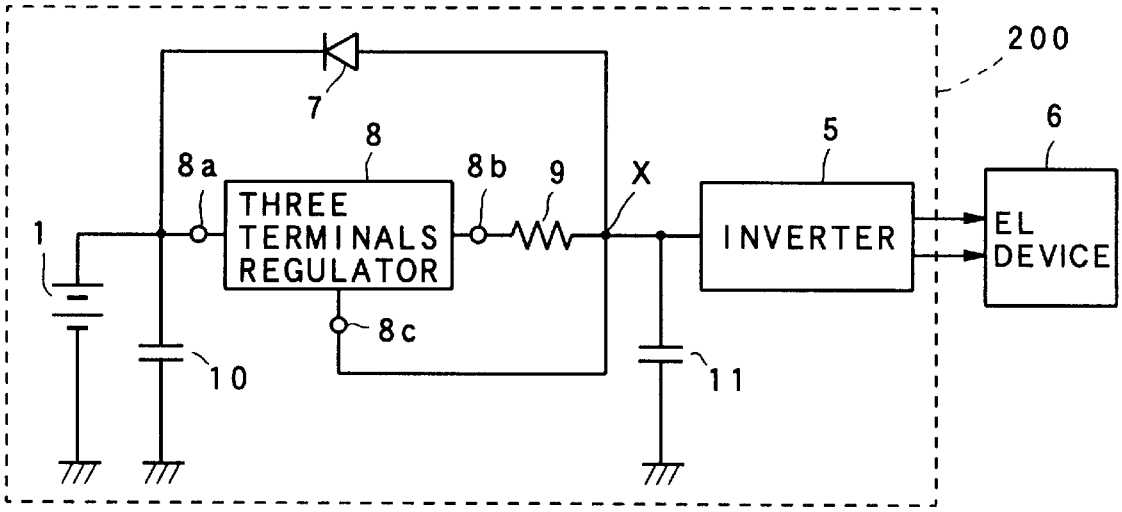
FIG. 1B is a block diagram showing an electroluminescence device driving apparatus of a second embodiment of the present invention.

FIG. 1B shows an EL device driving apparatus 200 of a second embodiment of the present invention. In FIG. 1B, same constructional elements as those in FIG. 1A carry the same reference numbers and explanations thereof are omitted.

As shown in FIG. 1B, the EL device driving apparatus 200 has a direct voltage source 1, a zener diode 7, a three terminals regulator 8 and a fixed resistance 9, an inverter 5, capacitors 10 and 11.

The zener diode 7 has a predetermined zener voltage, and makes a voltage of a direct current outputted from the direct voltage source 1 into a constant voltage of the zener voltage. Accordingly, the zener diode 7 performs as a constant-voltage device in which a direct current having a constant voltage is supplied to the inverter 5.

On the other hand, the three terminals regulator 8 and the fixed resistance 9 perform as a constant-current device in which a direct current having a constant current is supplied to the inverter 5.

The three terminals regulator 8 has an input terminal 8*a*, an output terminal 8*b* and a ground terminal 8*c*. Further, the three terminals regulator 8 has a function of changing an input voltage into a predetermined constant output voltage. Namely, when an input voltage is applied to the input terminal 8*a*, the three terminals regulator 8 changes the input voltage into a predetermined constant output voltage, and outputs the output voltage from the output terminal 8*b*. The output voltage appeared between the output terminal 8*b* and the ground terminal 8*c* is always constant while the input voltage is applied to the input terminal 8*a*.

Further, in the EL device driving apparatus 200 shown in FIG. 1B, the fixed resistance 9 is connected between the output terminal 8*b* and a load (i.e. the inverter 5 and EL device 6), and the ground terminal 8*c* is connected between the fixed resistance 9 and the load. As a result, the voltage $V_R$ appeared between the both sides of the fixed resistance 9 is always constant, and the current supplied to the load is always constant. The value of the current supplied to the load is obtained by a formula: (the voltage between the output terminal 8*b* and the ground terminal 8*c*)/(the value of the fixed resistance 9). Accordingly, the three terminals regulator 8 and the fixed resistance 9 perform as a constant-current device.

Further, in the EL device driving apparatus 200, the direct current supplied to the inverter 5 is automatically switched from the direct current outputted by the zener diode 7 to the direct current outputted by the three terminals regulator 8 and the fixed resistance 9.

Here, the operation of the EL device driving apparatus 200 will be explained in case of assuming the output voltage of the direct voltage source to be 10 [V], the zener voltage of the zener diode 7 to be −6 [V], the constant direct current flowing through the fixed resistance 9 to be 100 [mA], and the direct current flowing through the load which is constructed of the inverter 5 and the EL device 6 (Hereinafter, it it referred to as the "load Z".) at the beginning of driving the load Z to be 200 [mA].

In this case, the direct current flowing through the load Z is 200 [mA] at the beginning of driving the load Z. Namely, the value of the direct current flowing through the load Z is not less than that of the constant direct current flowing through the fixed resistance 9 at the beginning of driving the load Z. Therefore, the voltage applied to the load Z is decided by only the zener voltage, and thereby, the voltage applied to the load Z is always 4 [V] (10−6 [V]) at the beginning of driving the load Z (i.e. while the value of the direct current flowing into the load Z is not less than that of the constant direct current flowing through the fixed resistance 9). In this manner, the constant-voltage control is performed by the zener diode 7 at the beginning of driving the load Z.

Here, the EL device has the characteristic that the impedance thereof increased with the driving time, as mentioned above. Therefore, an impedance of the load Z also increases with a driving time of the load Z. For this reason, the direct current flowing through the load Z decreases with the driving time of the load Z. However, even if the direct current flowing through the load Z would decrease below 100 [mA], this is not possible actually, because the constant direct current flowing through the fixed resistance 9 is always 100 [mA]. Accordingly, if the impedance of the load Z increases with the driving time of the load Z, the decrease of the direct current flowing through the load Z is limited to 100 [mA] by the three terminals regulator 8 and the fixed resister 9. In addition, the voltage applied to the load Z can increases above than 4 [V] at this time. In this manner, the constant-current control is performed by the three terminals regulator 8 and the fixed resistance 9 after the beginning of driving the load Z.

As explained above, when the impedance of the load Z increases with the driving time of the load Z and the value of the direct current flowing through the load Z decrease to a certain value (100 [mA]) determined by the three terminals regulator 8 and the fixed resistance 9, the constant-voltage control by the zener diode 7 is automatically switched to the constant-current control by the three terminals regulator 8 and the fixed resistance 9. Further, the time of this switching operation is performed the time Tc shown in FIG. 2. Namely, a value of the constant direct current is decided by an experimentation so as to be equal the time Tc with the time when the value of the direct current flowing through the load Z decrease to the certain value.

According to the EL device driving apparatus 200 of the second embodiment, the same effects as those of the aforementioned EL device driving apparatus 100 of the first embodiment can be obtained. Further, according to the EL device driving apparatus 200, the constant-voltage control is automatically switched to the constant-current control, usability of the EL device driving apparatus is increased. Furthermore, the constant-voltage control is performed by the zener diode 7 and the constant-current control is performed by the three terminals regulator 8 and the fixed resistance 8. Thus, the configuration of the EL device driving apparatus 200 can be simplified.

III. Third Embodiment

Figure 1C:
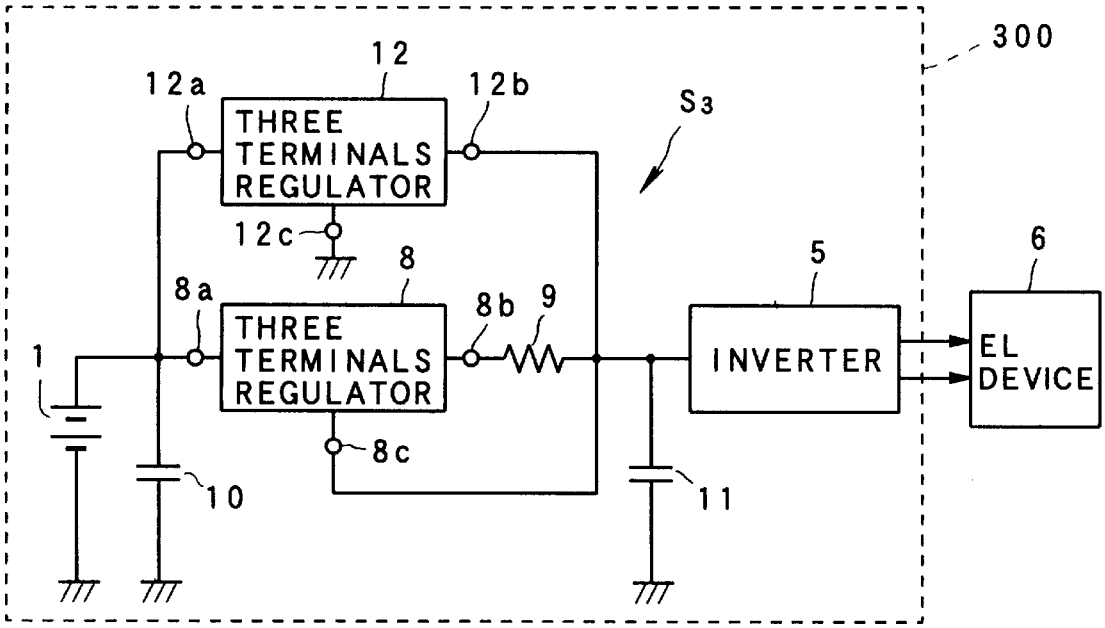
FIG. 1C is a block diagram showing an electroluminescence device driving apparatus of a third embodiment of the present invention.

FIG. 1C shows an EL device driving apparatus 300 of a third embodiment of the present invention. In FIG. 1C, same constructional elements as those in FIGS. 1A and 1B carry the same reference numbers and explanations thereof are omitted.

As shown in FIG. 1C, the EL device driving apparatus 300 of the third embodiment is different from that of the second embodiment in a point that the zener diode 7 is replaced by the three terminals regulator 12.

A ground terminal 12*c* of the three terminals regulator 12 is connected to the ground. Therefore, like the zener diode 7 of the second embodiment, the three terminals regulator 12 performs the constant-voltage control. Namely, the three terminals regulator 12 is performed such that an output voltage appeared between an output terminal 12*b* and the ground terminal 12*c* is constant (e.g. 4 [V]). Further, like the first embodiment, the constant-voltage control by the three terminals regulator 12 is automatically switched to the constant-current control by the three terminals regulator 8 and the fixed resistance 9.

In addition, in the aforementioned embodiments, the constant-voltage control is switched to the constant-current control on the basis of the predetermined time Tc or the change of the impedance of the load Z. However, the constant-voltage control is switched to the constant-current control on the basis of the brightness of the EL device. More concretely, a brightness detecting device for detecting the brightness of the EL device, such as a photo diode, is installed in the EL device driving apparatus. When the brightness of the EL device is higher than a predetermined brightness, the constant-voltage control is performed. When the brightness of the EL device is not higher than the predetermined brightness, the constant-current control is performed.

IV. Fourth Embodiment

Figure 3A:
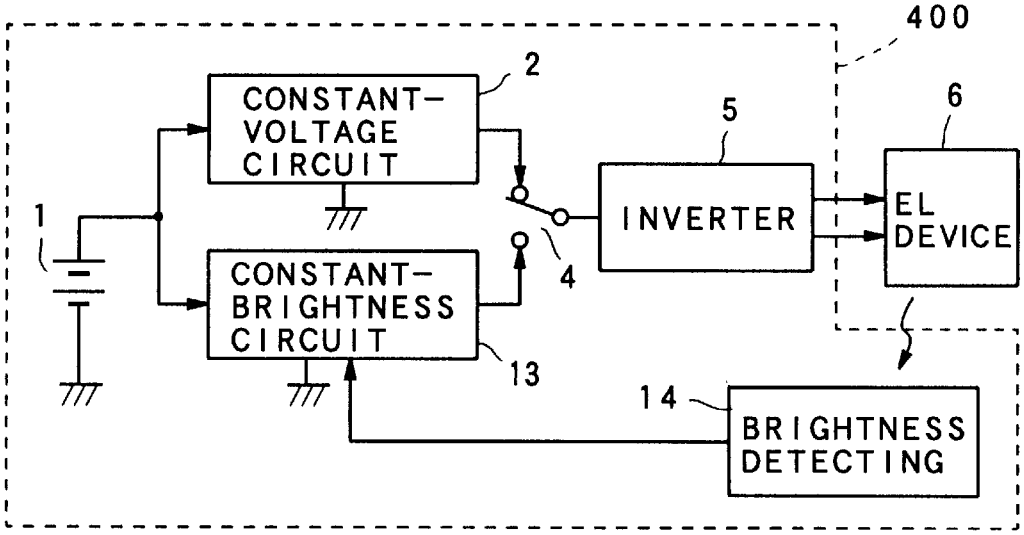
FIG. 3A is a block diagram showing an electroluminescence device driving apparatus of a fourth embodiment of the present invention.

FIG. 3A shows an EL device driving apparatus 400 of a fourth embodiment of the present invention. In FIG. 3A, same constructional elements as those in FIG. 1A carry the same reference numbers and explanations thereof are omitted.

As shown in FIG. 3A, the EL driving apparatus 400 has a direct voltage source 1, a constant-voltage circuit 2, a constant-brightness circuit 13, a brightness detecting device 14, a switch 4, and an inverter 5. Further, the inverter 5 is connected to an EL device 6.

Here, the constant-brightness circuit 13 performs the constant brightness control on the basis of the brightness of the EL device detected by the brightness detecting device 14. Concretely, the constant-brightness circuit 13 outputs a direct current (Hereinafter, it is referred to a "brightness compensation current".) to the switch 4. A voltage of the brightness compensation current increases with the decrease in the brightness of the EL device 6 in order to compensate the decrease of the brightness.

In the operation, a direct current outputted from the direct voltage source 1 is controlled by the constant-voltage circuit 2, and a direct current having a constant voltage is always outputted from the constant-voltage circuit 2 to the switch 4.

On the other hand, the constant-brightness circuit 13 generates the brightness compensation current by using the direct current outputted from the direct voltage source 1 on the basis of the brightness of the EL device detected by the brightness detecting device 14, so as to keep the brightness of the EL device constant, and outputs the generated brightness compensation current to the switch 4.

The switch 4 is connected to the constant-voltage circuit 2 at the beginning of driving the EL device 6, and the direct current having the constant voltage is supplied to the inverter 5. Further, the inverter 5 converts the direct current to an alternating current, and supplies the alternating current to the EL device 6 in order to drive the EL device 6.

Figure 4:
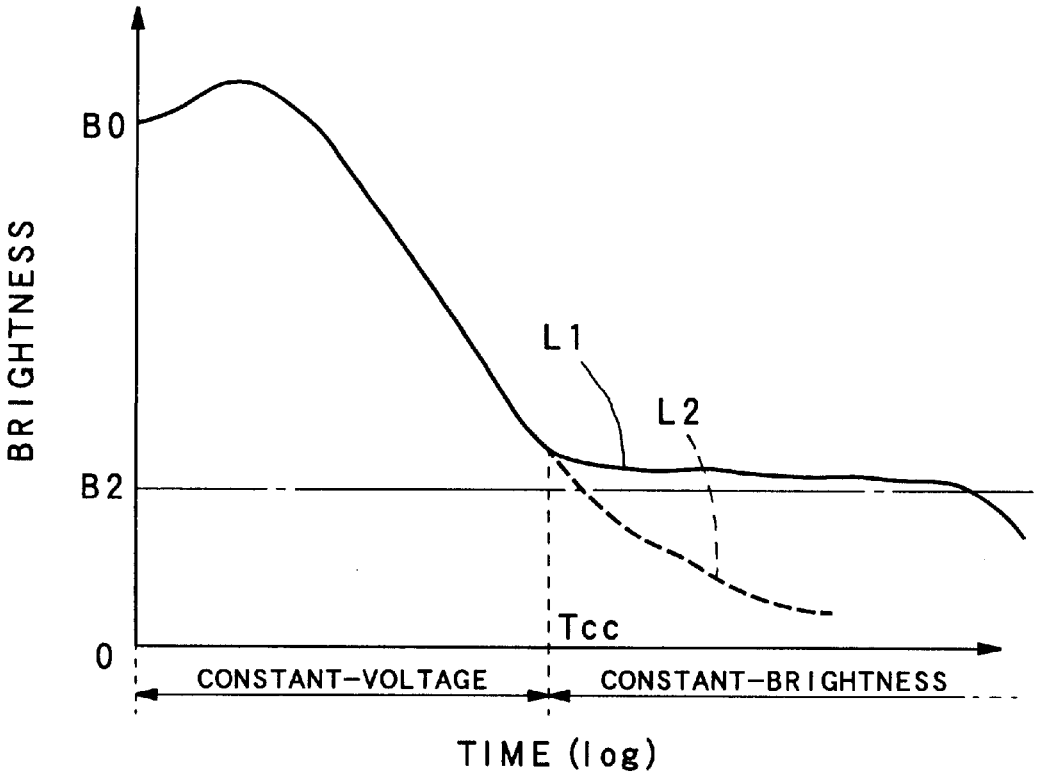
FIG. 4 is a graph showing a relation between time and brightness of the electroluminescence device in each of the fourth and the fifth embodiments of the present invention.

Next, the connection of the switch 4 is switched at the time of a Tcc shown in FIG. 4 in a manual operation by the user, with the result that the switch 4 is connected to the constant-brightness circuit 13. Therefore, the brightness compensation current outputted from the constant-brightness circuit 13 is supplied to the inverter 5 after the time Tcc. Further, the inverter 5 converts the brightness compensation current to an alternating current, and supplies the alternating current to the EL device 6 in order to drive the EL device 6. Since the voltage of the brightness compensation current increases with the decrease in the brightness of the EL device 6, the decrease of the brightness is compensated. Therefore, the brightness of the EL device 6 is not decrease below the lower limit B2 after the time Tcc, as shown by the solid line L1 in FIG. 4.

In FIG. 4, a solid line L1 indicates a relation between time and brightness of the EL device 6 when the EL device 6 is driven by using the EL device driving apparatus 400, and a dotted line L2 shown in FIG. 4 indicates a relation between time and brightness of the EL device 6 when the EL device is driven by using the constant-voltage system. As shown in FIG. 4, the brightness of the EL device 6 decreases with time while the EL device 6 is driven by applying the direct current having the constant voltage to the inverter 5 (i.e. while the EL device 6 is driven by the constant-voltage control or the constant-voltage system.). Immediately before the brightness of the EL device 6 decrease to a lower limit B2 thereof, the constant-voltage control by the constant-voltage circuit 2 is switched to the constant-brightness control by the constant-brightness circuit 13. Namely, the time Tcc is a time point immediately before the brightness of the EL device 6 decrease to the lower limit B2 thereof, as shown in FIG. 4. The lower limit B2 of the brightness is an effective brightness of the EL device 6. The effective brightness is decided by an use of the EL device 6.

Since the constant-voltage control is switched to the constant-brightness control immediately before the brightness of the EL device 6 decrease to the lower limit B2 thereof, it is possible to keep the brightness of the EL device 6 more than the lower limit B2 after the time Tcc, as shown by the solid line L1 in FIG. 4. According to the EL device driving apparatus 400, it is possible to extend the lifetime of the EL device 6 (i.e. to extend the period of time in which the EL device 6 keeps the effective brightness).

V. Fifth Embodiment

Figure 3B:
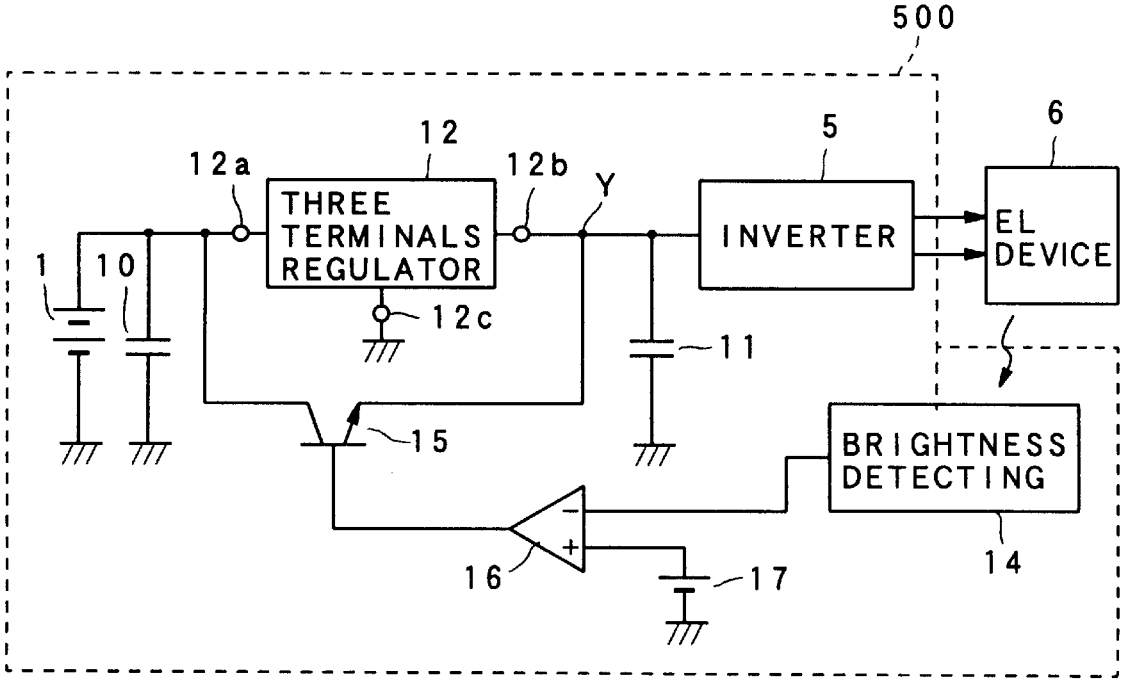
FIG. 3B is a block diagram showing an electroluminescence device driving apparatus of a fifth embodiment of the present invention.

FIG. 3B shows an EL device driving apparatus 500 of a fifth embodiment of the present invention. In FIG. 3B, same constructional elements as those in FIG. 1C carry the same reference numbers and explanation thereof are omitted.

As shown in FIG. 3B, the EL device driving apparatus 500 has a direct voltage source 1, a three terminals regulator 12, an inverter 5, a brightness detecting device 14, a transistor 15, an op-amp (operation amplifier) 16, a reference voltage supplying device 17, capacitors 10 and 11.

A ground terminal 12C of the three terminals regulator 12 is connected to the ground, and the three terminals regulator 12 always outputs a direct current having a constant voltage to the inverter 5. Accordingly, the three terminals regulator 12 performs the constant-voltage control.

On the other hand, a base terminal of the transistor 15 is connected to an output terminal of the op-amp 16, a collector terminal is connected to the direct voltage source 1, and an emitter terminal is connected to the inverter 5.

Next, the operation of the EL device driving apparatus 500 will be explained.

A direct current outputted from the direct voltage source 1 is limited to the predetermined constant voltage by the three terminals regulator 12. Therefore, a direct current having the predetermined constant voltage is always applied to the inverter 5.

On the other hand, the brightness compensation current outputted from the direct voltage source 1 is supplied to the transistor 15. The brightness compensation current of the fifth embodiment is the same that of the fourth embodiment in the properties.

Here, the operation of the transistor 15, the op-amp 16, and the brightness detecting device 14 will be explained. An output signal of the brightness detecting device 14 is inputted to an inverting input terminal of the op-amp 16 to be compared with a constant reference voltage inputted to the noninvertng input terminal. Further, in the op-amp 16, a difference between both voltages is outputted to the base terminal of the transistor 15.

Further, when the difference signal of the op-amp 16 is inputted to the base terminal of the transistor 15, the brightness compensation current corresponding to the difference signal is outputted from the emitter terminal of the transistor 15. Namely, if the voltage of the output signal outputted from the brightness detecting device 14 decreases with the decrease in the brightness of the EL device 6, the difference between this voltage and the reference voltage increases. Therefore, the voltage of the difference signal of the op-amp 16 increases. Accordingly, the voltage of the brightness compensation current outputted from the emitter terminal of the transistor 15 increases, with the result that the voltage applied to the EL device 6 through the inverter 5 increases. Thus, the reduction of the brightness of the EL device 6 is compensated.

Next, in the inverter 5, either the direct current having the constant voltage outputted from the three terminals regulator 12 (Hereinafter, it is referred to as a "constant voltage direct current".) or the brightness compensation current outputted from the transistor 15 to keep the brightness constant is converted into the alternating current, and is supplied to the EL device 6. Thus, the EL device 6 is driven.

Next, the switching operation between the constant voltage direct current outputted from three terminals regulator 12 and the brightness compensation current outputted from the transistor 15 will be explained in case of assuming the output voltage of the direct voltage source 1 to be 10 [V], the voltage drop of the three terminals regulator 12 to be −6 [V]. Further, the transistor 15 and the op-amp 16 (actually, the reference voltage of the reference voltage supplying device 17) are designed so as to keep the brightness of the EL device 6 not less than 100 [cd/m$^2$]. Furthermore, the brightness of the EL device 6 is 200 [cd/m$^2$] when the voltage of 4 [V] is applied to the load Z at the beginning of driving the load.

In this case, at the beginning of the driving the load Z, since the voltage drop is always −6 [V], the three terminals regulator 12 attempts to supply the constant voltage direct current having the voltage of 4 [V] to the load Z.

On the other hand, the transistor 15 and the op-amp 16 attempts to supply the brightness compensation current to the load Z in order to obtain the brightness of 100 [cd/m$^2$].

Now, since the brightness of the EL device 6 is 200 [cd/m$^2$] with applying the voltage of 4 [V], the transistor 15 and the op-amp 16 attempt to reduce the brightness to 100 [cd/m$^2$], and therefore, attempt to reduce the voltage at an output terminal (i.e. emitter terminal Y in shown in FIG. 3B) below 4 [V]. Namely, they attempt to cause the voltage drop between the input terminal 12*a* and the output terminal 12*b* to be less than −6 [V]. However, the three terminals regulator 12 prevents the voltage drop from being less than −6 [V] by its property. As a result, it is impossible to cause the voltage between the terminals 12*a* and 12*b* of the three terminals regulator 12 to be more than 6 [V].

Accordingly, the three terminals regulator 12 controls the voltage at the output terminal Y (i.e. 4 [V]) at the beginning of the driving the load Z. At this time, a current higher than the brightness compensation current determined by the transistor 15 and the op-amp 16 flows through the load Z.

As shown in FIG. 4, the EL device 6 deteriorates with time, and the brightness of the EL device 6 decreases. Then, when the driving time of the load Z ha s elapsed and has reached t he time Tcc, the brightness of 100 [cd/m$^2$] cannot be obtained any longer, even if the voltage of 4 [V] would be applied to the inverter 5.

In this case, the transistor 15 and the op-amp 16 attempt to decrease the voltage between the input terminal 12*a* and the output terminal Y below 6 [V], and attempt to increase the voltage at the output terminal Y above 4 [V], in order to prevent the brightness of the EL device 6 from being less than 100 [cd/m$^2$].

At this time, the three terminals regulator 12 allows to make the voltage drop more than −6 [V]. Therefore, it is possible to decrease the voltage between the terminals 12*a* and 12*b* of the three terminals regulator 12 below 6 [V].

Accordingly, after the brightness of the EL device 6 decreases with driving time of the EL device, the transistor 15 and the op-amp 16 control the voltage at the output terminal Y (i. e. the voltage at the output terminal Y is increased more than 4 [V] under the control by the transistor 15 and the op-amp 16.). As a result, the brightness compensation current is supplied to the inverter 5.

In addition, as shown in FIG. 4, the time Tcc is predetermined such that the brightness of the EL device 6 is a certain brightness (e.g. 100 [cd/m$^2$]) which is slightly higher than the lower limit B2 at the time Tcc.

According to the EL device driving apparatus 500, when the brightness of the EL device 6 is more than the predetermined brightness (i.e. the brightness slightly higher than the lower limit B2), the constant voltage direct current outputted from the three terminals regulator 12 is converted to the alternating current, and this alternating current is applied to the EL device 6. On the other hand, when the brightness of the EL device 6 is not more than the predetermined brightness, the brightness compensation current outputted from the transistor 15 is converted to the alternating current, and this alternating current is applied to the EL device 6. Thus, it is possible to extend the lifetime of the EL device 6.

Further, the constant voltage direct current is supplied by the three terminals regulator 12 and the brightness compensation current is supplied by the transistor 15. Accordingly, the configuration of the EL device driving apparatus 500 can be simplified.

In addition, in the EL device driving apparatus 500 of the fifth embodiment, a zener diode or a constant-voltage circuit may be installed instead of the three terminals regulator 12. In this configuration, the same effect can be obtained.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. An apparatus for driving an electroluminescence device by supplying an alternating current to said electroluminescence device, said apparatus comprising:

a direct voltage source;

a constant voltage control device for generating a direct current having a constant voltage on the basis of an output of said direct voltage source;

a constant current control device for generating a direct current having a constant current on the basis of said output of said direct voltage source;

a selecting device for selecting either one of said direct current having said constant voltage and said direct current having said constant current; and a converting device for converting said selected direct current to said alternating current to be supplied to said electroluminescence device.

2. An apparatus according to claim 1, wherein said selecting device selects said direct current having said constant voltage between a beginning of driving said electroluminescence device and a predetermined time and selects said direct current having said constant current after said predetermined time, and said predetermined time is predetermined on the basis of a change of brightness of said electroluminescence device.

3. An apparatus according to claim 2, wherein said predetermined time is a time when brightness of said electroluminescence device returns to an initial brightness after brightness of said electroluminescence device temporarily increases above said initial brightness at said beginning of driving said electroluminescence device.

4. An apparatus according to claim 2, wherein said predetermined time is a time immediately before brightness of the electroluminescence device decrease to a predetermined brightness, and said predetermined brightness corresponds to a lower limit of a brightness range that an effective brightness of said electroluminescence device is maintained.

5. An apparatus according to claim 1, wherein said selecting device comprises:

a current detecting device for detecting a current value of a direct current flowing into said converting device;

a determining device for determining whether or not said detected current value is less than a predetermined current value; and a switching device for switching from said direct current having said constant voltage to said direct current having said constant current when said determining device determines that said detected current value is less than said predetermined current value.

6. An apparatus according to claim 5, where in sai d predetermined current value is a current value of a direct current flow ing into said converting device when brightness of said electroluminescence device returns to an initial brightness after brightness of said electroluminescence device temporarily increases above said initial brightness at said beginning of driving said electroluminescence device.

7. An apparatus according to claim 1, wherein said selecting device comprises:

a brightness detecting device for detecting a brightness of said electroluminescence device;

a determining device for determining whether or not said detected brightness is less than a predetermined brightness; and a switching device for switching from said direct current having said constant voltage to said direct current having said constant current when said determining device determines that said detected brightness is less than said predetermined brightness.

8. An apparatus according to claim 1, wherein said constant voltage control device and said constant current control device are respectively connected between said direct voltage source and said converting device in parallel with each other.

9. An apparatus according to claim 1, wherein said constant voltage control device comprises a three terminals regulator.

10. An apparatus according to claim 1, wherein said constant voltage control device comprises a zener diode.

11. An apparatus according to claim 1, wherein said constant current control device comprises a three terminals regulator and a resistor connected with an output terminal of said three terminals regulator.

12. An apparatus for driving an electroluminescence device by supplying an alternating current to said electroluminescence device, said apparatus comprising:

a direct voltage source;

a constant voltage control device for generating a direct current having a constant voltage on the basis of an output of said direct voltage source;

a constant brightness control device for generating a direct current having a voltage which changes with a brightness of said electroluminescence device, on the basis of said output of said direct voltage source;

a selecting device for selecting either one of said direct current having said constant voltage and said direct current having said changing voltage; and a converting device for converting said selected direct current to said alternating current to be supplied to said electroluminescence device.

13. An apparatus according to claim 12, wherein said selecting device selects said direct current having said constant voltage between a beginning of driving said electroluminescence device and a predetermined time and selects said direct current having said changing voltage after said predetermined time, and said predetermined time is predetermined on the basis of a change of brightness of said electroluminescence device.

14. An apparatus according to claim 13, wherein said predetermined time is a time immediately before brightness of the electroluminescence device decrease to a predetermined brightness, and said predetermined brightness corresponds to a lower limit of a brightness range that an effective brightness of said electroluminescence device is maintained.

15. A method of driving an electroluminescence device by supplying an alternating current to said electroluminescence device, said method comprising the processes of:

generating a direct current having a constant voltage;

generating a direct current having a constant current;

selecting either one of said direct current having said constant voltage and said direct current having said constant current, on basis of an elapsed time from a beginning of driving said electroluminescence device; and converting said selected direct current to said alternating current to be supplied to said electroluminescence device.

16. A met hod according to claim 15, wherein, in said selecting process, said direct current having said constant voltage is selected between a beginning of driving said electroluminescence device and a predetermined time and said direct current having said constant current is selected after said predetermined time, and said predetermined time is predetermined on the basis of a change of brightness of said electroluminescence device.

17. A method according to claim 16, wherein said predetermined time is a time when brightness of said electroluminescence device returns to an initial brightness after brightness of said electroluminescence device temporarily increases above said initial brightness at said beginning of driving said electroluminescence device.

18. A method according to claim 16, wherein said predetermined time is a time immediately before brightness of the electroluminescence device decrease to a predetermined brightness, and said predetermined brightness corresponds to a lower limit of a brightness range that an effective brightness of said electroluminescence device is maintained.

19. A method according to claim 15, wherein said selecting process comprises the processes of:

detecting a current value of a direct current flowing into a converting device;

determining whether or not said detect ed current value is less than a predetermined current value; and switching from said direct current having said constant voltage to said direct current having said constant current when it is determined that said detected current value is less than said predetermined current value.

20. A method according to claim 19, wherein said predetermined current value is a current value of a direct current flowing into said converting device when brightness of said electroluminescence device returns to an initial brightness after brightness of said electroluminescence device temporarily increases above said initial brightness at said beginning of driving said electroluminescence device.

21. A met hod according to claim 15, wherein said selecting process comprises the processes of:

detecting a brightness of said electroluminescence device;

determining whether or not said detected brightness is less than a predetermined brightness; and switching from said direct current having said constant voltage to said direct current having said constant current when it is determined that said detected brightness is less than said predetermined brightness.

22. A method of driving an electroluminescence device by supplying an alternating current to said electroluminescence device, said method comprising the processes of;

generating a direct current having a constant voltage;

generating a direct current having a voltage which changes with a brightness of said electroluminescence device;

selecting either one of said direct current having said constant voltage and said direct having said changing voltage, on the basis of an elapsed time from a beginning of driving said electroluminescence device; and converting said selected direct current to said alternating current to be supplied to said electroluminescence device.

23. A method according to claim 22, wherein, in said selecting process, said direct current having said constant voltage is selected between a beginning of driving said electroluminescence device and a predetermined time and said direct current having said changing voltage is selected after said predetermined time, and said predetermined time is predetermined on the basis of a change of brightness of said electroluminescence device.

24. A method according to claim 23, wherein said predetermined time is a time immediately before brightness of the electroluminescence device decrease to a predetermined brightness, and said predetermined brightness corresponds to a lower limit of a brightness range that an effective brightness of said electroluminescence device is maintained.

* * * * *